US009767652B2

(12) United States Patent
Englman et al.

(10) Patent No.: US 9,767,652 B2
(45) Date of Patent: Sep. 19, 2017

(54) AUTOMATIC WAGERING GAME GENERATOR

(75) Inventors: Allon Englman, Chicago, IL (US); Rob Kyte, Chicago, IL (US); Michael W. Mastropietro, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 521 days.

(21) Appl. No.: 12/513,994

(22) PCT Filed: Nov. 8, 2007

(86) PCT No.: PCT/US2007/023499

§ 371 (c)(1),
(2), (4) Date: May 7, 2009

(87) PCT Pub. No.: WO2008/060426

PCT Pub. Date: May 22, 2008

(65) Prior Publication Data

US 2010/0062841 A1 Mar. 11, 2010

Related U.S. Application Data

(60) Provisional application No. 60/865,293, filed on Nov. 10, 2006.

(51) Int. Cl.
*A63F 9/24* (2006.01)
*G07F 17/32* (2006.01)

(52) U.S. Cl.
CPC ..... *G07F 17/3267* (2013.01); *G07F 17/32* (2013.01); *G07F 17/3223* (2013.01); *G07F 17/326* (2013.01); *G07F 17/3244* (2013.01); *G07F 17/3262* (2013.01)

(58) Field of Classification Search
CPC ..... G07F 17/34; G07F 17/32; G07F 17/326; G07F 17/3262; G07F 17/3267; G07F 17/3244
USPC ..... 463/16, 25, 29, 42, 20–22; 273/138.1, 273/139
See application file for complete search history.

(56) References Cited

U.S. PATENT DOCUMENTS

| | | | |
|---|---|---|---|
| 4,695,053 | A | 9/1987 | Vazquez et al. |
| 5,655,961 | A | 8/1997 | Acres et al. |
| 5,941,773 | A | 8/1999 | Harlick |
| 6,135,884 | A | 10/2000 | Hedrick, Jr. et al. |
| 6,190,255 | B1 | 2/2001 | Thomas et al. |

(Continued)

FOREIGN PATENT DOCUMENTS

| | | |
|---|---|---|
| AU | 2005251830 B2 | 12/2005 |
| EP | 0945837 | 9/1999 |

(Continued)

OTHER PUBLICATIONS

"European Application Serial No. 07861814.7, Extended European Search Report mailed Nov. 26, 2010", 7 pgs.

(Continued)

*Primary Examiner* — William H McCulloch, Jr.
*Assistant Examiner* — Chase Leichliter
(74) *Attorney, Agent, or Firm* — Nixon Peabody LLP

(57) ABSTRACT

Apparatus, systems, architectures, and methods provide a wagering game machine with instrumentality to enable a wagering game that may be automatically generated from identification of an activation event.

31 Claims, 7 Drawing Sheets

(56) References Cited

U.S. PATENT DOCUMENTS

| | | | | |
|---|---|---|---|---|
| 6,203,429 | B1 | 3/2001 | Demar et al. | |
| 6,234,897 | B1 | 5/2001 | Frohm et al. | |
| 6,375,570 | B1 | 4/2002 | Poole | |
| 6,443,837 | B1 | 9/2002 | Jaffe et al. | |
| RE37,885 | E | 10/2002 | Acres et al. | |
| 6,561,900 | B1 | 5/2003 | Baerlocher et al. | |
| 6,565,436 | B1 | 5/2003 | Baerlocher | |
| 6,648,757 | B1 | 11/2003 | Slomiany et al. | |
| 6,860,810 | B2 | 3/2005 | Cannon et al. | |
| RE38,812 | E | 10/2005 | Acres et al. | |
| 6,960,134 | B2 | 11/2005 | Hartl et al. | |
| 7,144,321 | B2 | 12/2006 | Mayeroff | |
| 7,235,011 | B2 | 6/2007 | Randall et al. | |
| 7,278,919 | B2 | 10/2007 | Souza et al. | |
| 7,285,049 | B1 | 10/2007 | Luciano, Jr. et al. | |
| 7,445,548 | B1 | 11/2008 | Muskin | |
| 7,722,453 | B2 | 5/2010 | Lark et al. | |
| 7,771,264 | B2 * | 8/2010 | Kane et al. | 463/16 |
| 7,914,377 | B2 | 3/2011 | Benbrahim et al. | |
| 7,967,675 | B1 * | 6/2011 | Delaney et al. | 463/20 |
| 8,202,158 | B2 | 6/2012 | Anderson et al. | |
| 2001/0011797 | A1 | 8/2001 | Pierce et al. | |
| 2002/0025847 | A1 | 2/2002 | Thomas et al. | |
| 2002/0039919 | A1 | 4/2002 | Joshi et al. | |
| 2002/0090990 | A1 | 7/2002 | Joshi et al. | |
| 2002/0142825 | A1 | 10/2002 | Lark | |
| 2002/0175466 | A1 | 11/2002 | Loose et al. | |
| 2003/0036423 | A1 | 2/2003 | Vancura | |
| 2003/0060266 | A1 | 3/2003 | Baerlocher | |
| 2003/0060281 | A1 * | 3/2003 | Vancura | 463/30 |
| 2003/0114218 | A1 | 6/2003 | McClintic | |
| 2003/0153375 | A1 | 8/2003 | Vancura | |
| 2003/0176215 | A1 * | 9/2003 | Palmer et al. | 463/25 |
| 2003/0176220 | A1 * | 9/2003 | Baerlocher | 463/26 |
| 2004/0048649 | A1 | 3/2004 | Peterson et al. | |
| 2004/0048655 | A1 | 3/2004 | Yoshioka | |
| 2004/0048657 | A1 | 3/2004 | Gauselmann | |
| 2004/0092315 | A1 * | 5/2004 | Boyd et al. | 463/42 |
| 2004/0106446 | A1 | 6/2004 | Cannon et al. | |
| 2004/0147306 | A1 | 7/2004 | Randall et al. | |
| 2004/0166918 | A1 | 8/2004 | Walker | |
| 2004/0185930 | A1 | 9/2004 | Thomas et al. | |
| 2004/0219969 | A1 | 11/2004 | Casey et al. | |
| 2005/0096121 | A1 | 5/2005 | Gilliland et al. | |
| 2005/0159208 | A1 | 7/2005 | Pacey | |
| 2005/0159211 | A1 | 7/2005 | Englman | |
| 2005/0164765 | A1 * | 7/2005 | Okuniewicz | 463/16 |
| 2005/0170877 | A1 * | 8/2005 | Okuniewicz | 463/16 |
| 2005/0187004 | A1 | 8/2005 | Vancura | |
| 2005/0215311 | A1 | 9/2005 | Hornik et al. | |
| 2005/0250568 | A1 * | 11/2005 | Kane et al. | 463/16 |
| 2006/0014582 | A1 | 1/2006 | Harris et al. | |
| 2006/0025200 | A1 | 2/2006 | Van Asdale | |
| 2006/0035707 | A1 | 2/2006 | Nguyen et al. | |
| 2006/0046819 | A1 * | 3/2006 | Nguyen et al. | 463/16 |
| 2006/0073879 | A1 | 4/2006 | Baerlocher | |
| 2006/0073887 | A1 | 4/2006 | Nguyen | |
| 2006/0073888 | A1 | 4/2006 | Nguyen | |
| 2006/0073897 | A1 | 4/2006 | Englman et al. | |
| 2006/0089190 | A1 * | 4/2006 | Bryant et al. | 463/20 |
| 2006/0089195 | A1 * | 4/2006 | Walker et al. | 463/25 |
| 2006/0142079 | A1 | 6/2006 | Ikehara | |
| 2006/0166733 | A1 | 7/2006 | Hettinger | |
| 2007/0060314 | A1 | 3/2007 | Baerlocher et al. | |
| 2007/0060321 | A1 | 3/2007 | Vasquez | |
| 2007/0191088 | A1 | 8/2007 | Breckner et al. | |
| 2007/0218975 | A1 | 9/2007 | Iddings et al. | |
| 2007/0225065 | A1 | 9/2007 | Wright et al. | |
| 2007/0259709 | A1 | 11/2007 | Kelly et al. | |
| 2007/0293293 | A1 | 12/2007 | Baerlocher et al. | |
| 2007/0298857 | A1 | 12/2007 | Schlottmann et al. | |
| 2007/0298874 | A1 | 12/2007 | Baerlocher et al. | |
| 2007/0298875 | A1 | 12/2007 | Baerlocher et al. | |
| 2008/0020830 | A1 | 1/2008 | Ikehara et al. | |
| 2008/0020831 | A1 | 1/2008 | Ikehara et al. | |
| 2008/0020832 | A1 | 1/2008 | Iddings et al. | |
| 2008/0020833 | A1 | 1/2008 | Baerlocher et al. | |
| 2008/0020834 | A1 | 1/2008 | Breckner et al. | |
| 2008/0020846 | A1 | 1/2008 | Vasquez et al. | |
| 2008/0045344 | A1 | 2/2008 | Schlottmann et al. | |
| 2008/0064502 | A1 | 3/2008 | Schlottmann et al. | |
| 2008/0070680 | A1 | 3/2008 | Baerlocher et al. | |
| 2008/0070692 | A1 | 3/2008 | Schlottmann et al. | |
| 2008/0070693 | A1 | 3/2008 | Schlottmann et al. | |
| 2008/0070694 | A1 | 3/2008 | Schlottmann et al. | |
| 2008/0070695 | A1 | 3/2008 | Baerlocher et al. | |
| 2008/0076514 | A1 | 3/2008 | Baerlocher et al. | |
| 2008/0076515 | A1 | 3/2008 | Baerlocher et al. | |
| 2008/0076517 | A1 | 3/2008 | Baerlocher et al. | |
| 2008/0076552 | A1 | 3/2008 | Baerlocher et al. | |
| 2009/0291752 | A1 | 11/2009 | Anderson et al. | |
| 2009/0305776 | A1 | 12/2009 | Englman et al. | |
| 2010/0029369 | A1 | 2/2010 | Pacey | |
| 2010/0048283 | A1 | 2/2010 | Anderson et al. | |
| 2010/0048293 | A1 | 2/2010 | Hornik | |

FOREIGN PATENT DOCUMENTS

| | | | |
|---|---|---|---|
| EP | 1453023 | | 9/2004 |
| WO | WO-03006129 | A1 | 1/2003 |
| WO | WO-2006076185 | A2 | 7/2006 |
| WO | WO-2008030904 | A2 | 3/2008 |
| WO | WO-2008063408 | A3 | 3/2008 |
| WO | WO-2008060429 | A2 | 5/2008 |
| WO | WO-2008060429 | A3 | 5/2008 |
| WO | WO-2008060442 | A2 | 5/2008 |
| WO | WO-2008060442 | A3 | 5/2008 |
| WO | WO-2008060442 | C2 | 5/2008 |
| WO | WO-2008060459 | A2 | 5/2008 |
| WO | WO-2008060459 | A3 | 5/2008 |
| WO | WO-2008060513 | A2 | 5/2008 |
| WO | WO-2008060513 | A3 | 5/2008 |
| WO | WO-2008063408 | A2 | 5/2008 |

OTHER PUBLICATIONS

U.S. Appl. No. 12/513,974, Examiner Interview Summary mailed Apr. 22, 2011, 3 pgs.

U.S. Appl. No. 12/513,974, Non Final Office Action mailed Feb. 2, 2011, 15 pgs.

U.S. Appl. No. 12/513,974, Response filed May 2, 2011 to Non Final Office Action mailed Feb. 2, 2011, 11 pgs.

U.S. Appl. No. 12/514,019, Examiner Interview Summary mailed Apr. 25, 2011, 4 pgs.

U.S. Appl. No. 12/514,019, Non Final Office Action mailed Jan. 20, 2011, 9 pgs.

U.S. Appl. No. 12/514,019, Response filed Apr. 2, 2011 to Non Final Office Action mailed Jan. 20, 2011, 12 pgs.

U.S. Appl. No. 12/514,038, Non Final Office Action mailed Jan. 5, 2011, 10 pgs.

U.S. Appl. No. 12/514,038, Response filed Apr. 5, 2011 to Non Final Office Action mailed Jan. 5, 2011, 10 pgs.

U.S. Appl. No. 12/514,421 Non-Final Office Action mailed Oct. 8, 2010, 18 pgs.

U.S. Appl. No. 12/514,421, Response filed Feb. 8, 2011 to Non Final Office Action mailed Oct. 8, 2011, 11 pgs.

U.S. Appl. No. 12/514,426, Non Final Office Action mailed Feb. 3, 2011, 11 pgs.

"European Application Serial No. 07839999.5, Extended European Search Report mailed Apr. 6, 2011", 6 pgs.

"International Application Serial No. PCT/US2007/023389, International Report on Patentability completed Nov. 16, 2010", 15 pgs.

"International Application Serial No. PCT/US2007/023389, International Search Report mailed May 9, 2008", 2 pgs.

"International Application Serial No. PCT/US2007/023389, International Written Opinion mailed May 9, 2008", 7 pgs.

"International Application Serial No. PCT/US2007/023499, International Report on Patentability, mailed Jul. 24, 2009", 7 pgs.

"International Application Serial No. PCT/US2007/023503, International Preliminary Report on Patentability, mailed Jul. 16, 2009".

(56) References Cited

OTHER PUBLICATIONS

"International Application Serial No. PCT/US2007/023503, Search Report mailed Jul. 23, 2008", 2 pgs.
"International Application Serial No. PCT/US2007/023503, Written Opinion mailed Jul. 23, 2008", 5 pgs.
"International Application Serial No. PCT/US2007/023572, International Preliminary Report on Patentability, mailed Jun. 18, 2009", 14 pgs.
"International Application Serial No. PCT/US2007/023572, International Search Report mailed May 9, 2008", 2 pgs.
"International Application Serial No. PCT/US2007/023572, International Written Opinion mailed May 9, 2008", 7 pgs.
"International Application Serial No. PCT/US2007/023636, International Report on Patentability mailed Jun. 18, 2009", 10 pgs.
"International Application Serial No. PCT/US2007/023636, Search Report mailed Jun. 23, 2008", 2 pgs.
"International Application Serial No. PCT/US2007/023636, Written Opinion mailed Jun. 23, 2008", 7 pgs.
"International Application Serial No. PCT/US2007/023753 Search Report mailed Jun. 23, 2008", 2 pgs.
"International Application Serial No. PCT/US2007/023753 Written Opinion mailed Jun. 23, 2008", 8 pgs.
"International Application Serial No. PCT/US2007/023753, International Report on Patentability mailed Jun. 18, 2009", 11 pgs.
U.S. Appl. No. 12/513,974 , Response filed Sep. 27, 2011 to Final Office Action mailed Jun. 29, 2011, 17 pgs.
U.S. Appl. No. 12/513,974, Final Office Action mailed Jun. 29, 2011, 26 pgs.
U.S. Appl. No. 12/514,019, Final Office Action mailed Jul. 21, 2011, 15 pgs.
U.S. Appl. No. 12/514,038, Examiner Interview Summary Received Apr. 6, 2011, 3 pgs.
U.S. Appl. No. 12/514,038, Final Office Action mailed Jun. 24, 2011, 11 pgs.
U.S. Appl. No. 12/514,038, Non Final Office Action mailed Sep. 13, 2011, 12 pgs.
U.S. Appl. No. 12/514,038, Response filed Aug. 24, 2011 to Final Office Action mailed Jun. 24, 2011, 12 pgs.
U.S. Appl. No. 12/514,421, Final Office Action mailed Jun. 2, 2011, 17 pgs.
U.S. Appl. No. 12/514,426, Final Office Action mailed Sep. 12, 2011, 14 pgs.
U.S. Appl. No. 12/514,426, Response filed May 23, 2011 to Non Final Office Action mailed Feb. 3, 2011, 10 pgs.
U.S. Appl. No. 12/514,421. Response filed Sep. 30, 2011 to Final Office Action mailed Jun. 2, 2011, 16 pgs.
U.S. Appl. No. 12/513,974, Examiner Interview Summary mailed Aug. 31, 2011, 3 pgs.
U.S. Appl. No. 12/513,974, Preliminary Amendment filed May 7, 2009, 3 pgs.
U.S. Appl. No. 12/514,019, Appeal Brief filed Jan. 17, 2012, 33 pgs.
U.S. Appl. No. 12/514,019, Examiner's Answer to Appeal Brief mailed Jun. 6, 2012, 18 pgs.
U.S. Appl. No. 12/514,019, Reply Brief filed Jul. 18, 2012, 9 pgs.
U.S. Appl. No. 12/514,038, Advisory Action mailed Jun. 28, 2012, 3 pgs.
U.S. Appl. No. 12/514,038, Examiner Interview Summary mailed Aug. 31, 2011, 3 pgs.
U.S. Appl. No. 12/514,038, Examiner Interview Summary mailed Dec. 12, 2011, 3 pgs.
U.S. Appl. No. 12/514,038, Final Office Action mailed Apr. 16, 2012, 10 pgs.
U.S. Appl. No. 12/514,038, Preliminary Amendment filed May 7, 2009, 13 pgs.
U.S. Appl. No. 12/514,038, Response filed Jun. 18, 2012 to Final Office Action mailed Apr. 16, 2012, 11 pgs.
U.S. Appl. No. 12/514,038, Response filed Jul. 16, 2012 to Final Office Action mailed Apr. 16, 2012, 13 pgs.
U.S. Appl. No. 12/514,038, Response filed Dec. 13, 2011 to Non Final Office Action mailed Sep. 13, 2011, 14 pgs.
U.S. Appl. No. 12/514,426, 312 Amendment filed May 14, 2012, 8 pgs.
U.S. Appl. No. 12/514,426, Examiner Interview Summary mailed May 24, 2011, 4 pgs.
U.S. Appl. No. 12/514,426, Notice of Allowance mailed Feb. 14, 2012, 12 pgs.
U.S. Appl. No. 12/514,426, Preliminary Amendment filed May 11, 2009, 7 pgs.
U.S. Appl. No. 12/514,426, PTO Response to 312 Amendment mailed May 24, 2012, 2 pgs.
U.S. Appl. No. 12/514,426, Response filed Dec. 22, 2011 to Final Office Action mailed Sep. 12, 2011, 16 pgs.
"Australian Application Serial No. 2007319884, Examiner Report Mailed Dec. 9, 2011", 2 pgs.
"Australian Application Serial No. 2007319923—Office Action Response", 17 pgs.
"Australian Application Serial No. 2007319923, Examiner Report mailed Dec. 19, 2011", 2 pgs.
"Australian Application Serial No. 2007319923, Response filed Mar. 7, 2012 to Examiner Report mailed Dec. 19, 2011", 5 pgs.
"Austrailian Application Serial No. 2007319923, Second Examiners Report mailed Apr. 12, 2012", 2 pgs.
"Australian Application Serial No. 2007319986, Examiner's Report mailed Dec. 7, 2011", 2 pgs.
"Australian Application Serial No. 2007319986, Response filed Aug. 3, 2012 to Examiner's Report mailed Dec. 7, 2011", 20 pgs.
"Australian Application Serial No. 2007319989, Office Action mailed Jan. 13, 2012", 2 pgs.
"Australian Application Serial No. 2007319989, Response filed Aug. 3, 2012 to Examiner Report mailed Jan. 13, 2012", 20 pgs.
"Australian Application Serial No. 2007320002, Examiner Report mailed Aug. 7, 2012", 3 pgs.
"Australian Application Serial No. 2007320002, Examiner Report mailed Dec. 7, 2011", 2 pgs.
"Australian Application Serial No. 2007320002, Response filed Aug. 3, 2012 to Examiner Report mailed Dec. 7, 2011", 16 pgs.

* cited by examiner

AUTOMATIC WAGERING GAME GENERATOR

RELATED APPLICATION

This patent application is a U.S. National Stage Filing under 35 U.S.C. 371 from International Patent Application Serial No. PCT/US2007/023499, filed Nov. 8, 2007, and published on May 22, 2008, as WO 2008/060426 A2 and republished as WO 2008/060426 A3, which claims the priority benefit of U.S. Provisional Patent Application Ser. No. 60/865,293 filed Nov. 10, 2006 and entitled "AUTOMATIC WAGERING GAME GENERATOR", which applications are incorporated herein by reference in their entirety.

FIELD

Embodiments of the inventive subject matter relate generally to wagering game systems.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2006, 2007 WMS Gaming, Inc.

BACKGROUND

Wagering game machine makers continually provide new and entertaining games. One way of increasing entertainment value associated with casino-style wagering games (e.g., video slots, video poker, video black jack, and the like) includes offering a variety of base games and bonus events. However, despite the variety of base games and bonus events, players often lose interest in repetitive wagering gaming content. In order to maintain player interest, wagering game machine makers frequently update wagering game content with new game themes, game settings, bonus events, game software, and other electronic data. Consequently, there is a need to provide for seamless integration of base wagering games, bonus wager games, game themes, game settings, game software, and other electronic data to ensure an attractive gaming experience.

BRIEF DESCRIPTION OF THE FIGURES

Embodiments of the invention are illustrated by way of example and not limitation in the Figures of the accompanying drawings in which.

DESCRIPTION

Various embodiments of the invention are described by way of example and not limitation in the following description:

Example Operating Environment

Example Wagering Game Machine Architecture

Figure 1:
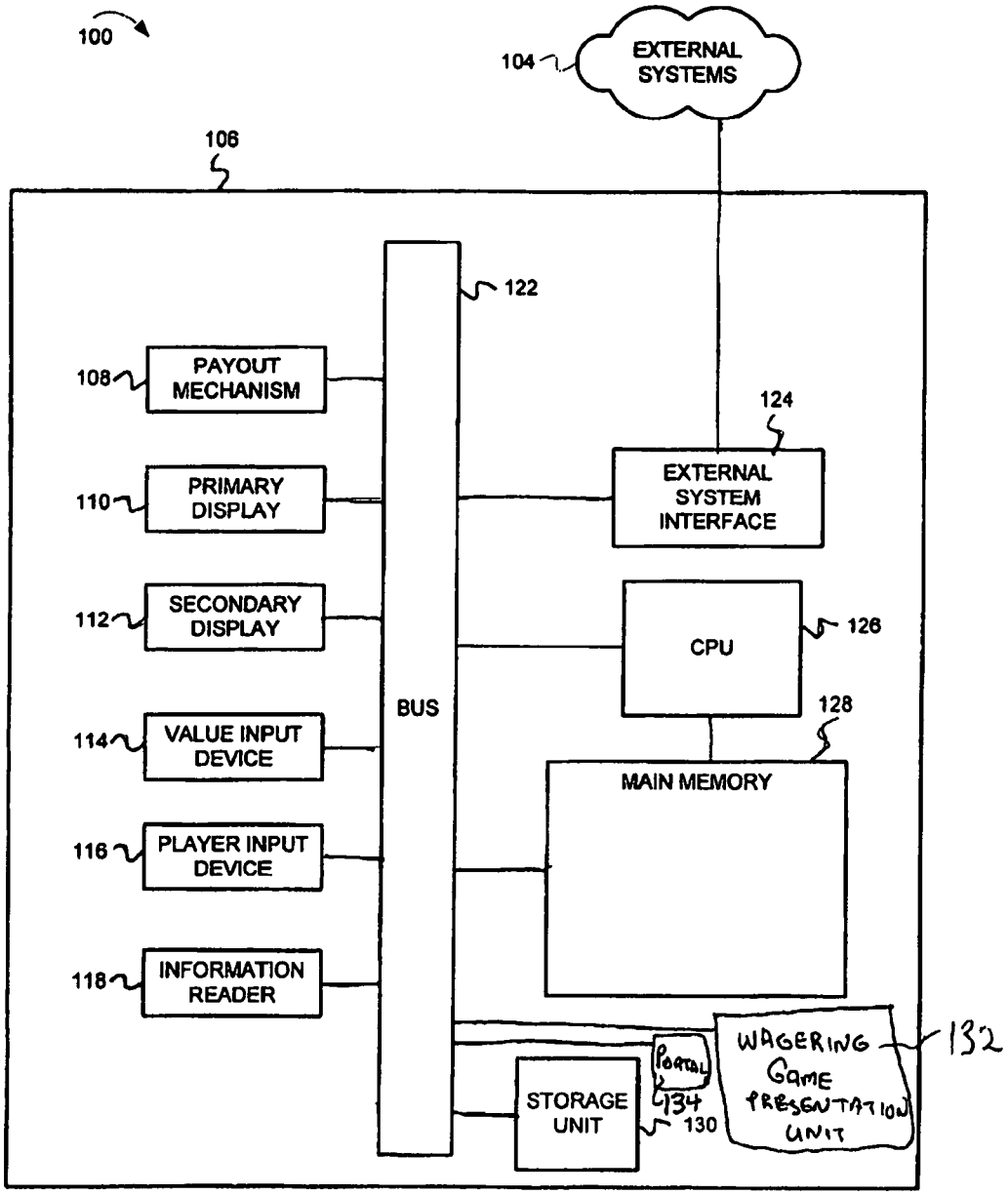
FIG. 1 shows a block diagram illustrating an embodiment of a wagering game machine architecture.

FIG. 1 shows a block diagram illustrating an embodiment of a wagering game machine architecture 100 having a wagering game machine 106. Wagering game machine 106 may be adapted to receive a wager from a player in association with a wagering game to be presented to the player. Wagering game machine 106 may include a central processing unit (CPU) 126, a main memory 128, a wagering game presentation unit 132, and a portal 134. CPU 126 may be realized using various forms of a processor and/or controller. Main memory 128 may be coupled through a bus 122 or directly to CPU 126 using a communication medium such as a memory bus. A bus may include command control lines, data lines, address lines, other communication lines, or combinations thereof.

Wagering game presentation unit 132 may be an independent unit in wagering game machine 106. Wagering game presentation unit 132 may include a processor and/or controller, memory, or combinations thereof. An independent wagering game presentation unit 132 may operate with CPU 126 and/or main memory via bus 122 or via a direct connection. Wagering game presentation unit 132 may be realized as integral to main memory 128. Wagering game presentation unit 132 may be realized having components in CPU 126 and in main memory 128. In various embodiments, wagering game presentation unit 132 may present, in whole or part, wagering games such as video poker, video black jack, video slots, video lottery, video role playing games having wagering content, etc.

A portal is an instrumentality that may provide personalized capabilities, provide a pathway to other content, or combinations thereof. A portal may use distributed applications, different numbers and types of software based components that couple two or more applications to enable data transfer between the applications, hardware to provide services from a number of different sources, and may be realized on a variety of platforms such as servers, content management systems, personal computers (PCs), personal digital assistants (PDAs), mobile phones, stand-alone wagering game machines, distributed wager game machines, or combinations thereof. A portal may include or provide access to subroutine code, code libraries, application program interfaces such as interpreters utilizing Java EE™, Simple DirectMedia Layer™ (SDL) and DirectX™, or combinations thereof. Portal 134 may be realized as an independent component, embedded in wagering game presentation unit 132, embedded in main memory 128, distributed among CPU 126 and wagering game presentation unit 132, distributed among main memory 128 and wagering game presentation unit 132, distributed among CPU 126, main memory 128, and wagering game presentation unit 132, distributed among different components of wagering game machine architecture 100, or various combinations thereof. Portal 134 may be physically exterior to wagering game machine 106. In an embodiment, portal 134 may be adapted to generate a wagering game in response to an activation event. In an embodiment, portal 134 may be adapted to identify an activation event associated with a first wagering game, where the activation event may be used to initiate the building of a second wagering game, to determine criteria to generate the second wagering game, and to generate the features of the second wagering game in response to the activation event according to the criteria. These features may be symbols in an array for the second wagering game.

CPU 126 may be connected to bus 122 to facilitate communication between the components of wagering game machine 106 and other components and/or systems exterior to wagering game machine 106. Bus 122 may be configured as an input/output (I/O) bus 122. I/O bus 122 may be connected to a payout mechanism 108, primary display 110, secondary display 112, value input device 114, player input device 116, information reader 118, and storage unit 130. Player input device 116 may include value input device 114 to the extent the player input device 116 may be used to place wagers. I/O bus 122 may also be connected to an external system interface 124, which may be connected to external systems 104 (e.g., wagering game networks).

In an embodiment, wagering game machine 106 may include additional peripheral devices and/or more than one of each component shown in FIG. 1. For example, in an embodiment, wagering game machine 106 may include multiple external system interfaces 124 and multiple CPUs 126. In an embodiment, any of the components may be integrated or subdivided. Additionally, in an embodiment, the components of wagering game machine 106 may be interconnected according to any suitable interconnection architecture (e.g., directly connected, hypercube, etc.).

In an embodiment, any of the components of wagering game machine 106 (e.g., wagering game presentation unit 132) may include hardware, firmware, and/or software for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Figure 2:
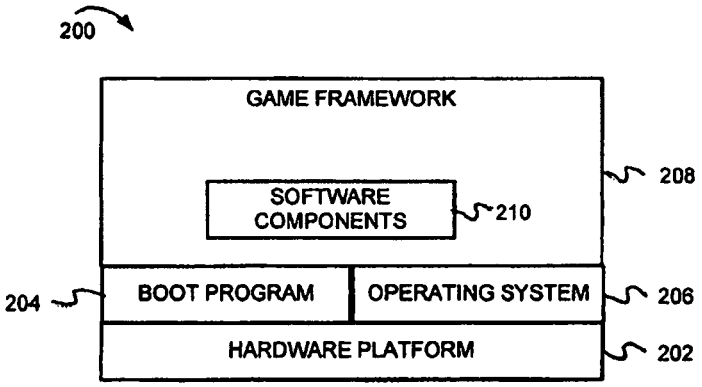
FIG. 2 shows a block diagram of features of an embodiment of an architecture for a wagering game system.

FIG. 2 shows a block diagram of features of an embodiment of an architecture for a wagering game system 200. The wagering game architecture includes a hardware platform 202, a boot program 204, an operating system 206, and a game framework 208 that includes one or more wagering game software components 210. In various embodiments, hardware platform 202 may include a thin-client, thick-client, or some intermediate derivation. A thin client may be a client in client-server architecture networks which has little or no application logic, so it has to depend primarily on a central server for processing activities. A client may use a small boot image to connect to a network and start up a dedicated web browser. A thin client may load its operating system (OS) and software from a server. A thin client may be a client in which no data is stored and relatively little processing occurs on the client machine. Thick clients may be full-featured computers that are connected to a network. A thick client, which may also be referenced as also heavy clients, may be configured as functional machines whether they are connected to a network or not, unlike typical thin clients, which may lack hard drives and other features.

Hardware platform 202 may also be configured to provide a virtual client. Boot program 204 may include a basic input/output system (BIOS) or other initialization program that works in conjunction with operation system 206 to provide a software interface to hardware platform 202. Game framework 208 may include standardized game software components either independent or in combination with specialized or customized game software components that are designed for a particular wagering game. In an embodiment, wagering game software components 210 may include software operative in connection with hardware platform 202 and operating system 206 to present wagering games, in whole or part, such as video poker, video black jack, video slots, video lottery, video role playing games having wagering content, etc. In an embodiment, software components 210 may include software operative to accept a wager from a player. According to an embodiment, game software components 210 include one or more components to provide a wagering game that is automatically generated based on an initiation event, which may include selection of an activation event in another wagering game. According to an embodiment, one or more of the software components 210 may be provided as part of the operating system 206 or other software used in the wagering game system 200 (e.g., libraries, daemons, common services, etc.).

Figure 3:
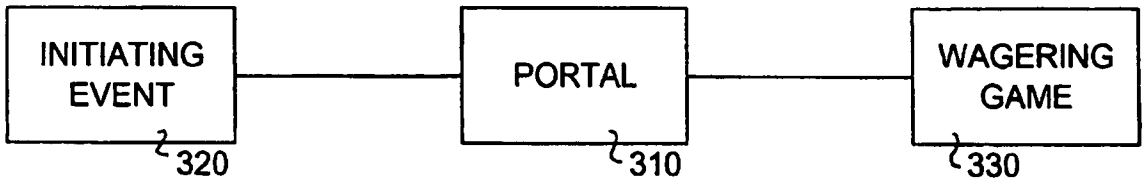
FIG. 3 illustrates a block diagram of an embodiment of a relationship for a portal to automatically generate a wagering game.

FIG. 3 illustrates an embodiment of a portal 310 to automatically generate a wagering game. Portal 310 provides instrumentality to automatically build a wagering game 330 in response to an initiation event 320. Wagering game 330 may be built based on selection of one or more features or parameters for game play. Such features or parameters may include selection of volatility of the wagering game, game themes, game settings, other selection parameters, or combinations thereof. Volatility is a measure of how a player experiences the pay back of a particular game. Some games pay out more often in smaller amounts. This is known as a low volatility game. Some games pay out less often in larger amounts. This is known as a high volatility game. With a feature or parameter selection providing initiation event 320, portal 310 provides for the generation of wagering game 330.

Figure 4:
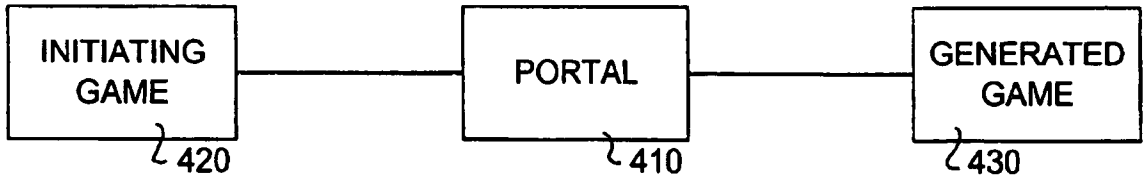
FIG. 4 illustrates a block diagram of an embodiment of a relationship for a portal to automatically generate a wagering game.

FIG. 4 illustrates an embodiment of a portal 410 to automatically generate a wagering game. Portal 410 provides instrumentality to automatically supply a generated game 430 from an event associated with an initiating game 420. Generated game 430 may be a base wagering game generated upon selection of a bonus wagering game 420 as an initiation event. Generated game 430 may be a bonus wagering game generated upon selection of a bonus wagering game 420 and/or one or more other parameters from a base wagering game.

In generating a wagering game, portal 310 and/or portal 410 may provide for the building of symbols in an array. The construction of the wagering game may include building reel strips according to certain criteria. The criteria may be a rule set associated with an initiation event or features identified by the occurrence of the initiation event. In an embodiment, a bonus wagering game is selected from multiple bonus wagering games and reel strips for a base wagering game are generated based on the selection of the bonus wagering game. In such a configuration, a player selects one or more bonus wagering game from a set of games, and then a base wagering game is displayed for the player. The multiple bonus wagering games from which one or more is selected may be a set of known bonus wagering games. These bonus wagering games may be selected from a library of bonus wagering games. The reel strips and payouts generated in the base wagering game may be constructed with an expected value for the payout of the known bonus wagering games remaining substantially fixed. An expected value (EV) is the average number of credits a pay or feature pays on average over the long run. It may be calculated as a percentage of the overall payback of a given game and may be provided by multiplying the average pay of the feature times its probability of occurring. In an embodiment, a total expected value of a game may be taken as the sum of the expected value of the base wagering game and each expected value of each selected bonus wagering game, with the total expected value of the game remaining substantially constant with each construction of a wagering game in response to the initiation event.

The parameters and features of the bonus wagering games in the library may reside at one or more locations in a wagering game network. In an embodiment, a different rule set may be associated with each bonus wagering game and/or each combination of bonus wagering games. A rule set may include a rule that a given set of bonus wagering games cannot be selected together to generate a base wagering game.

In an embodiment, building a wagering game upon initiation of an event may include the real-time generation of probabilities associated with winning combinations in the generated game. The manner in which the probabilities are generated may be based on one or more rule sets. The rule sets may be stored in device, system, and/or network components. The rule sets may be formulated according to a language similar to those used with artificial intelligence and expert based systems. In an embodiment, a rule set provides a set of criteria to generate reel strips in which certain parameters are to be met. For example, various identified symbols may be kept apart in the generation of reel strips where a given symbol may only occur in a specified frequency range on one reel strip and another symbol with another frequency range may be displayed on a different reel strip of the generated game. In an embodiment, a rule set determines the rules that a generated game is allowed to operate under based on predetermined parameters. The rule set rule basically constrains game features and characteristics so that the game will be generated arbitrarily at the time that the initiation event occurs. The generated reel strips may provide an unseen element of the game play for the player, in which the player provides the initiation event by selecting various game features. The various game features may include selection of one or more bonus wagering games, selection of volatility, selection of game themes, selection of game settings, selection of other features or parameters, or combinations thereof.

In an embodiment, each bonus wagering game in a non-singular set of bonus wagering games works with any base wagering game by changing the base wagering game to operate with each bonus game. The base wagering game may be dynamically built with the expected values of the bonus wagering games remaining substantially constant to a known value associated with the bonus wagering games. The reel strips for the base wagering game may be built substantially real-time such that the EVs, features, and the pay of the bonus wagering games remains fixed to given values. In building the base wagering game, various items may be added to the base wagering game such as secondary symbols. In an embodiment, the reel strips of the base wagering game may be entirely adjusted. In an embodiment, various selections of bonus wagering games and/or other parameters may be simulated and base wagering games generated. Once the relationship is formed, the selection of a specific bonus wagering game or games and/or specific other parameters during normal game play provides an initiation event for a processor to automatically upload the base wagering game generated from simulation of the same selection as made in game play. The generated base wagering game may be uploaded from any device or system that can communicate with the wagering game being played.

Example Operations

Figure 5:
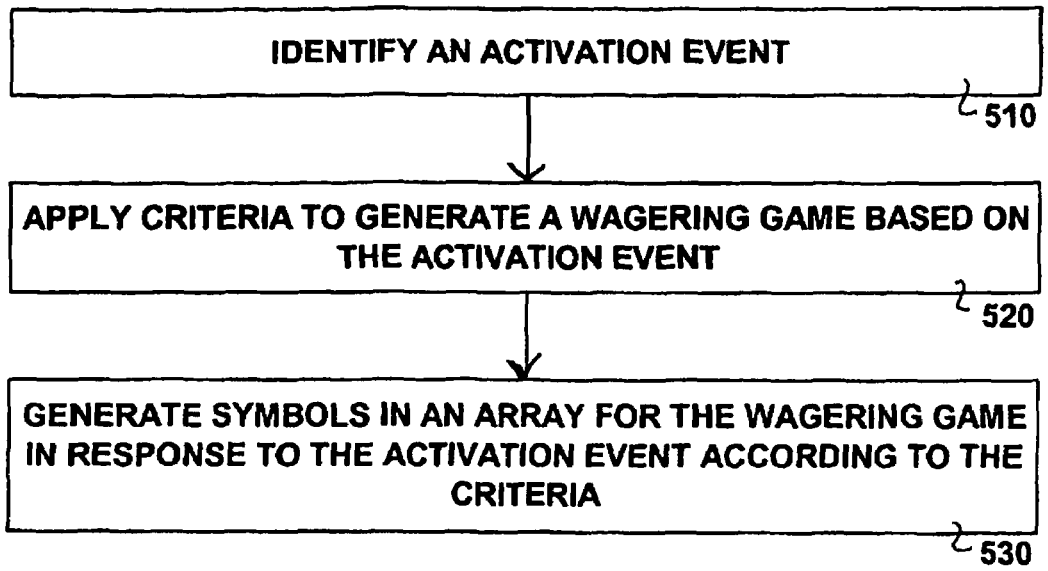
FIG. 5 illustrates a flow diagram of features of an embodiment for a portal to automatically generate a wagering game.

FIG. 5 illustrates a flow diagram of features of an embodiment for a portal to automatically generate a wagering game. At 510, an activation event is identified. An activation event may include receiving data or a signal regarding features or parameters at a portal. The features or parameters may be generated in response to player selection. The features or parameters may include selection of one or more bonus games, selection of a specific volatility, selection of game themes, selection of game settings, selection of other features or parameters, or combinations thereof. Such selection may be provided through activation of a touch screen, activation of one or more buttons on a wagering game device or system, clicking of a computer-like mouse, activation of a screen display using electromagnetic stimulus wirelessly generated, or combinations of various selection actions. The data provided to the portal may be generated as information calculated or derived in response to a selection event.

At 520, criteria are applied to generate a wagering game based on the activation event. The criteria may be one or more rule sets associated with the activation event. Various rule sets may be used to apply constraints relating to a set of bonus wagering games, game volatility, expected values associated with a game to be generated, other features and parameters, or combinations thereof. The rule sets may be accessed from various locations including, but not limited to, memory in a wagering game machine, a storage unit in a wagering game machine, a wagering game presentation unit in a wagering game machine, a portal in a wagering game machine, memory external to a wagering game machine, a storage unit external to a wagering game machine, a wagering game presentation unit external to a wagering game machine, a portal external to a wagering game machine, or combinations thereof. Devices, modules, or systems external to a wagering game machine may be located on a wagering game network, which may be a local area network (LAN) or a wide area network (WAN).

At 530, symbols are generated in an array for the wagering game in response to the activation event according to the criteria. The symbols may be generated on reel strips. The number of reel strips and the length of each of the reel strips may be determined during the building of the wagering game using one or more rule sets. In addition to generating symbols and reel strips, various graphics may be generated to be displayed along with the constructed reel strips. Providing a video image through the use of various graphics formats with automatically generated reel strips may enhance the player participation and enjoyment of the generated game.

Figure 6:
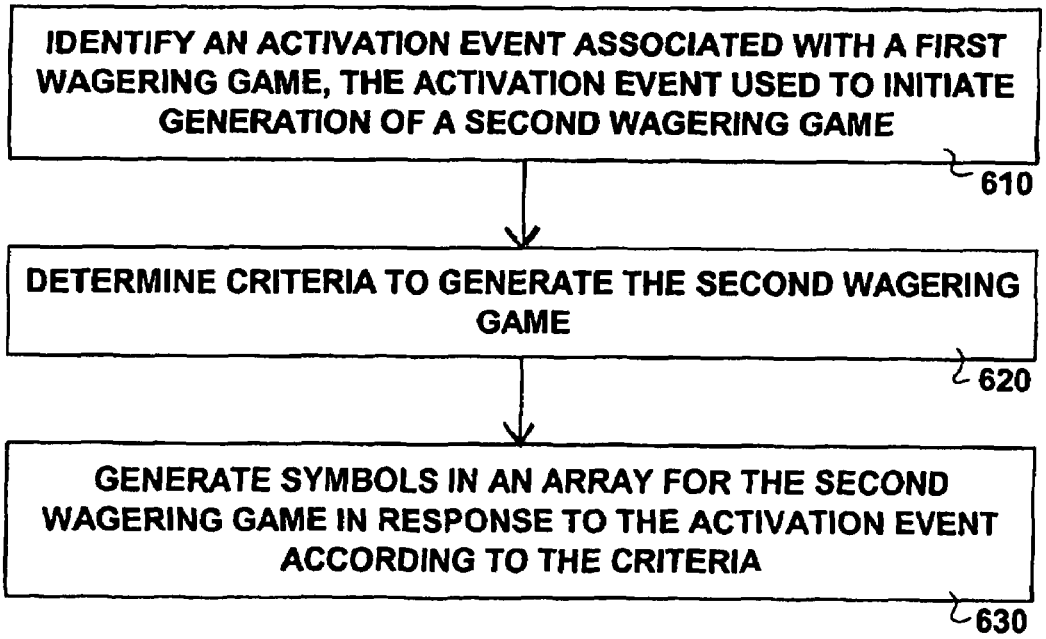
FIG. 6 illustrates a flow diagram of features of an embodiment for a portal to automatically generate a wagering game.

FIG. 6 illustrates a flow diagram of features of an embodiment for a portal to automatically generate a wagering game. At 610, an activation event is identified, where the activation event is associated with a first wagering game and is used to initiate generation of a second wagering game. The first wagering game may be a bonus wagering game with the second wagering game being a base wagering game. The first wagering game may be a base wagering game with the second wagering game being a bonus wagering game. In generating a bonus wagering game, additional parameters may be selected such that the activation event includes an activity in addition to selecting a known bonus wagering game. An activation event may include receiving data or a signal regarding features or parameters at a portal. The features or parameters may be generated in response to player selection. The features or parameters may include selection of one or more bonus games, selection of a specific volatility, selection of game themes, selection of game settings, selection of other features or parameters, or combinations thereof. Such selection may be provided through activation of a touch screen, activation of one or more buttons on a wagering game device or system, clicking of a computer-like mouse, activation of a screen display using electromagnetic stimulus wirelessly generated, or combinations of various selection actions. The data provided to the portal may be generated as information calculated or derived in response to a selection event At 620, criteria are determined to generate the second wagering game. Determination of the criteria may include identifying a rule set associated with the activation event. In an embodiment in which a base wagering game is to be generated upon selection of one or more bonus wagering games, a rule set may include maintaining the EV and/or features associated with the selected bonus wagering games substantially constant. Various rule sets may be used to apply constraints relating to a set of bonus wagering games, game volatility, expected values associated with a game to be generated, other features and parameters, or combinations thereof. The rule sets may be accessed from various locations including, but not limited to, memory in a wagering game machine, a storage unit in a wagering game machine, a wagering game presentation unit in a wagering game machine, a portal in a wagering game machine, memory external to a wagering game machine, a storage unit external to a wagering game machine, a wagering game presentation unit external to a wagering game machine, a portal external to a wagering game machine, or combinations thereof. Devices, modules, or systems external to a wagering game machine may be located on a wagering game network, which may be a local area network or a wide area network.

At 630, symbols are generated in an array for the second wagering game in response to the activation event according to the criteria. The symbols may be generated on reel strips. The number of reel strips and the length of the reel strips may be determined during the building of the second wagering game using one or more rule sets. In addition to generating symbols and reel strips, various graphics may be generated to be displayed along with the constructed reel strips. Providing graphics with automatically generated reel strips may enhance the player participation and enjoyment of the second wagering game.

Example Wagering Game Network

Figure 7:
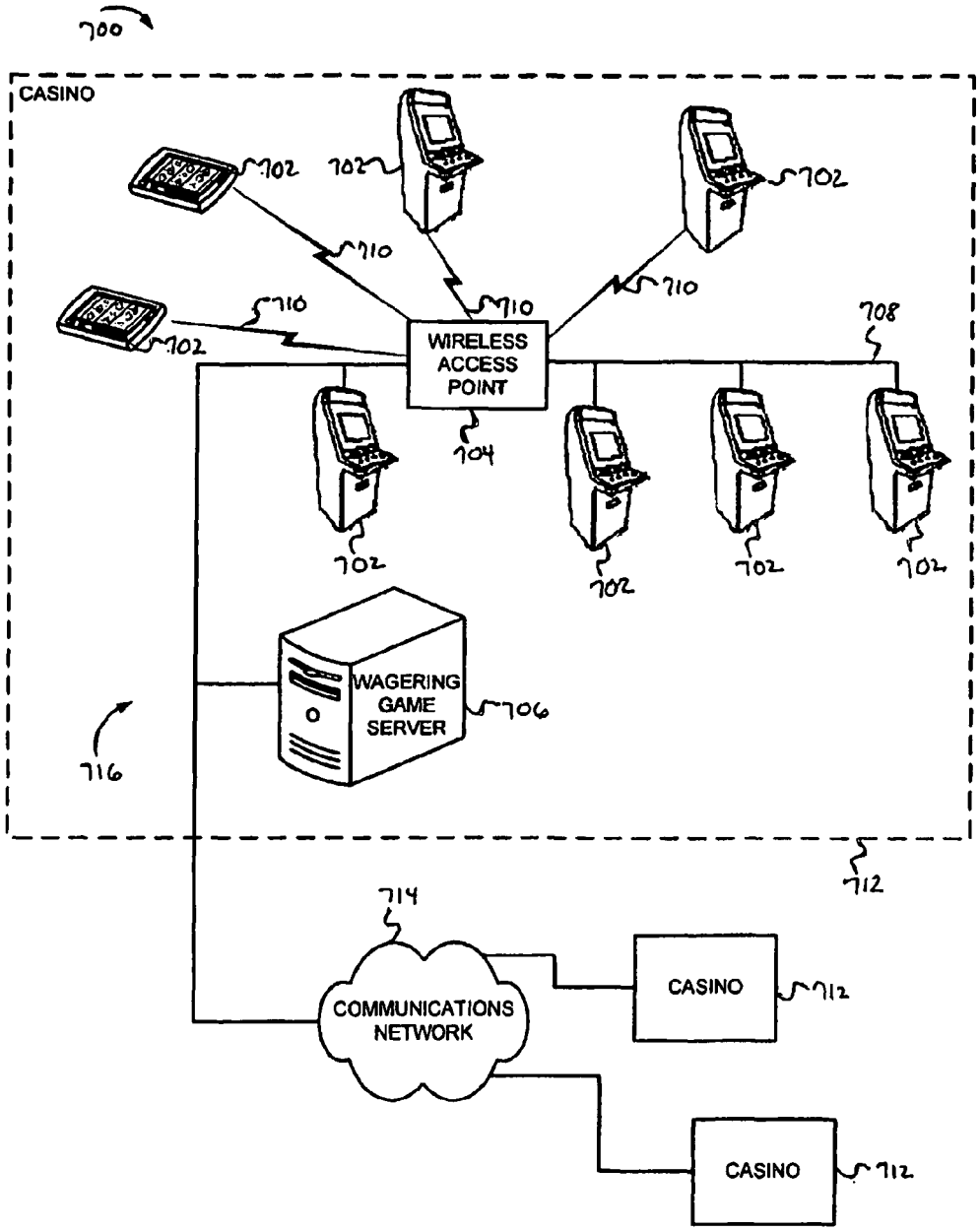
FIG. 7 shows a block diagram illustrating an embodiment of a wagering game network.

FIG. 7 shows a block diagram illustrating an embodiment of a wagering game network 700, according to example embodiments of the invention. Wagering game network 700 may include multiple casinos 712 connected to a communications network 714.

Each casino 712 may include a local area network 716, which may include a wireless access point 704, a wagering game machines 702, and a wagering game server 706 that may serve wagering games over the local area network 716. Wireless access point 704 may control routing on both wireless communication channels and wired communication channels. Such a wireless access point 704 may be realized as a router capable or routing signals between and among wired devices, wireless devices, and devices having wired and wireless capability. In a non-wireless environment, wireless access point may be replaced by a routing device. Local area network 716 may include wireless communication links 710 and wired communication links 708. The wired and wireless communication links may employ any suitable connection technology, such as Bluetooth, 802.11, Ethernet, public switched telephone networks, SONET, etc. In an embodiment, the wagering game server 706 may serve wagering games and/or distribute content to devices located in other casinos 712 or at other locations on communications network 714.

Wagering game machines 702 and wagering game server 706 may include hardware and machine-readable media including instructions for performing embodiments of the operations described herein.

Wagering game machines 702 described herein may take any suitable form, such as floor standing models, handheld mobile units, bartop models, workstation-type console models, etc. Further, wagering game machines 702 may be primarily dedicated for use in conducting wagering games, or may include non-dedicated devices, such as mobile phones, personal digital assistants, personal computers, etc. In an embodiment, the wagering game network 700 may include other network devices, such as accounting servers, wide area progressive servers, player tracking servers, and/or other devices suitable for use in connection with embodiments of the invention.

In various embodiments, wagering game machines 702 and wagering game servers 706 work together such that wagering game machine 702 may be operated as a thin, thick, or intermediate client. For example, one or more elements of game play may be controlled by wagering game machine 702 (client) or the wagering game server 706 (server). Game play elements may include executable game code, lookup tables, configuration files, game outcome, audio or visual representations of the game, game assets or the like. In a thin-client example, wagering game server 706 may perform functions such as determining game outcome or managing assets, while wagering game machine 702 may be used merely to present the graphical representation of such outcome or asset modification to the user (e.g., player). In a thick-client example, game outcome may be determined locally (e.g., at wagering game machine 702) and then communicated to wagering game server 706 for recording or managing a player's account.

Similarly, functionality not directly related to game play may be controlled by wagering game machine 702 (client) or the wagering game server 706 (server) in embodiments. For example, power conservation controls that manage a display screen's light intensity may be managed centrally (e.g., by wagering game server 706) or locally (e.g., by wagering game machine 702). Other functionality not directly related to game play may include presentation of advertising, software or firmware updates, system quality or security checks, etc.

Example Wireless Environment

In some embodiments, wireless access point 704 and wagering game machines 702 may communicate using orthogonal frequency division multiplexed (OFDM) communication signals over a multicarrier communication channel. The multicarrier communication channel may be within a predetermined frequency spectrum and may include multiple orthogonal subcarriers. In some embodiments, the multicarrier signals may be defined by closely spaced OFDM subcarriers. Each subcarrier may have a null at substantially a center frequency of the other subcarriers and/or each subcarrier may have an integer number of cycles within a symbol period. In some embodiments, wireless access point 704 and wagering game machines 702 may communicate in accordance with a broadband multiple access technique, such as orthogonal frequency division multiple access (OFDMA). In some embodiments, wireless access point 704 and wagering game machines 702 may communicate using spread-spectrum signals.

In some embodiments, wireless access point 704 may be part of a communication station, such as wireless local area network (WLAN) communication station including a Wireless Fidelity (WiFi) communication station, or a WLAN access point (AP). In these embodiments, wagering game machines 702 may be part of a mobile station, such as WLAN mobile station or a WiFi mobile station.

In some other embodiments, wireless access point 704 may be part of a broadband wireless access (BWA) network communication station, such as a Worldwide Interoperability for Microwave Access (WiMax) communication station, as wireless access point 704 may be part of almost any wireless communication device. In these embodiments, wagering game machines 702 may be part of a BWA network communication station, such as a WiMax communication station.

In some embodiments, any of wagering game machines 702 may be part of a portable wireless communication device, such as a personal digital assistant, a laptop or portable computer with wireless communication capability, a web tablet, a wireless telephone, a wireless headset, a pager, an instant messaging device, a digital camera, a television, or other device that may receive and/or transmit information wirelessly.

In some embodiments, the frequency spectrums for the communication signals transmitted and received by wireless access point 704 and wagering game machines 702 may include a 5 gigahertz (GHz) frequency spectrum, a 2.4 GHz frequency spectrum, or other frequency spectrum. In these embodiments, the 5 GHz frequency spectrum may include frequencies ranging from approximately 4.9 to 5.9 GHz, and the 2.4 GHz spectrum may include frequencies ranging from approximately 2.3 to 2.5 GHz, but other frequency spectrums are also equally suitable. In some BWA network embodiments, the frequency spectrum for the communication signals may include frequencies between 2 and 11 GHz.

In some embodiments, wireless access point 704 and wagering game machines 702 may communicate RF signals in accordance with specific communication standards, such as the Institute of Electrical and Electronics Engineers (IEEE) standards including IEEE 802.11(a), 802.11(b), 802.11(g), 802.11(h) and/or 802.11(n) standards and/or proposed specifications for wireless local area networks, but they may also be suitable to transmit and/or receive communications in accordance with other techniques and standards. In some BWA network embodiments, wireless access point 704 and wagering game machines 702 may communicate RF signals in accordance with the IEEE 802.16-2004 and the IEEE 802.16(e) standards for wireless metropolitan area networks (WMANs) including variations and evolutions thereof. However, they may also be suitable to transmit and/or receive communications in accordance with other techniques and standards. For more information with respect to the IEEE 802.11 and IEEE 802.16 standards, please refer to "IEEE Standards for Information Technology—Telecommunications and Information Exchange between Systems"—Local Area Networks—Specific Requirements—Part 11 "Wireless LAN Medium Access Control (MAC) and Physical Layer (PHY), ISO/IEC 8802-11: 1999", and Metropolitan Area Networks—Specific Requirements—Part 16: "Air Interface for Fixed Broadband Wireless Access Systems," May 2005 and related amendments/versions.

In some embodiments, wireless access point 704 and wagering game machines 702 may communicate in accordance with standards such as the Pan-European mobile system standard referred to as the Global System for Mobile Communications (GSM). In some embodiments, wireless access point 704 and wagering game machines 702 may also communicate in accordance with packet radio services such as the General Packet Radio Service (GPRS) packet data communication service. In some embodiments, wireless access point 704 and wagering game machines 702 may communicate in accordance with the Universal Mobile Telephone System (UMTS) for the next generation of GSM, which may, for example, implement communication techniques in accordance with 2.5G and third generation (3G) wireless standards (See 3GPP Technical Specification, Version 3.2.0, March 2000, for example). In some of these embodiments, wireless access point 704 and wagering game machines 702 may provide packet data services (PDS) utilizing packet data protocols (PDP). In other embodiments, wireless access point 704 and wagering game machines 702 may communicate in accordance with other standards or other air-interfaces including interfaces compatible with the enhanced data for GSM evolution (EDGE) standards (see 3GPP Technical Specification, Version 3.2.0, March 2000, for example).

In other embodiments, wireless access point 704 and wagering game machines 702 may communicate in accordance with a short-range wireless standard, such as the Bluetooth™ short-range digital communication protocol. Bluetooth™ wireless technology is a de facto standard, as well as a specification for small-form factor, low-cost, short-range radio links between mobile PCs, mobile phones and other portable devices. (Bluetooth is a trademark owned by Bluetooth SIG, Inc.) In other embodiments, wireless access point 704 and wagering game machines 702 may communicate in accordance with an ultra-wideband (UWB) communication technique where a carrier frequency is not used. In other embodiments, wireless access point 704 and wagering game machines 702 may communicate in accordance with an analog communication technique. In other embodiments, wireless access point 704 and wagering game machines 702 may communicate in accordance with an optical communication technique, such as the Infrared Data Association (IrDA) standard. In some embodiments, wireless access point 704 and wagering game machines 702 may communicate in accordance with the Home-RF standard which may be in accordance with a Home-RF Working Group (HRFWG) standard.

In some embodiments, handoffs between different wireless access points 704 and one of wagering game machines 702 may be performed based on a signal-to-noise ratio (SNR), a signal-to-noise and interference ratio (SNIR), a bit-error rate (BER), or an energy per received bit

Example Wagering Game Machines

Example Wagering Game Machine

Figure 8:
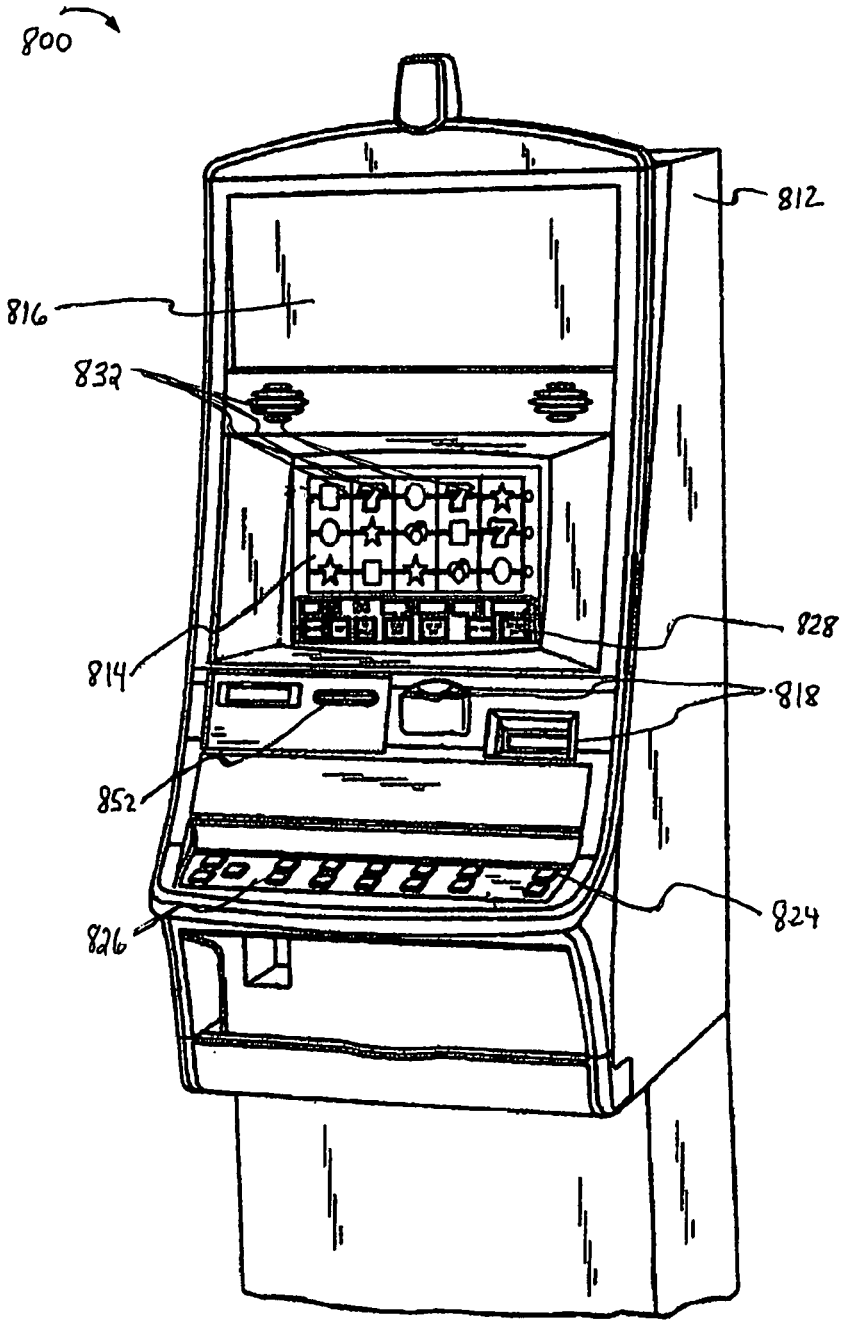
FIG. 8 illustrates an example embodiment of a wagering game machine.

FIG. 8 illustrates an embodiment of a wagering game machine 800 in which a wagering game generated in accordance with an embodiment of the present invention may be displayed and/or initiated. Wagering game machine 800 may be used in gaming establishments, such as casinos. In various embodiments, wagering game machine 800 may be any type of wagering game machine and may have varying structures and methods of operation. For example, wagering game machine 800 may be an electromechanical wagering game machine configured to play mechanical slots, or it may be an electronic wagering game machine configured to play video casino games, such as blackjack, slots, keno, poker, blackjack, roulette, video role playing games having wagering content, etc.

Wagering game machine 800 may include a housing 812 having input devices that may include value input devices 818 and a player input device 824. For output, wagering game machine 800 may include a primary display 814 for displaying information about a basic wagering game. Primary display 814 may also display information about a bonus wagering game and a progressive wagering game. A progressive wagering game is associated with a progressive award, which is an award that starts with a base reset amount, in which, subsequently, a small percentage of each players bet is added to this award until a player triggers the pay where it reset back to its original amount. A stand alone progressive award is a progressive award that is for one game only. A local area progressive award is a progressive award that is linked to games within a casino. A wide area progressive award is a progressive award that is linked to an entire gaming jurisdiction, such as an entire state.

Wagering game machine 800 also may include a secondary display 816 for displaying wagering game events, wagering game outcomes, and/or signage information. While some components of wagering game machine 800 are described herein, numerous other elements may exist and may be used in any number or combination to create varying forms of wagering game machine 800.

Value input devices 818 may take any suitable form and may be located on the front of housing 812. Value input devices 818 may receive currency and/or credits inserted by a player. Value input devices 818 may include coin acceptors for receiving coin currency and bill acceptors for receiving paper currency. Furthermore, value input devices 818 may include ticket readers or barcode scanners for reading information stored on vouchers, cards, or other tangible portable storage devices. The vouchers or cards may authorize access to central accounts, which may transfer money to wagering game machine 800.

Player input device 824 may include multiple push buttons on a button panel 826 for operating wagering game machine 800. In addition, or alternatively, player input device 824 may include a touch screen 828 mounted over primary display 814 and/or secondary display 816.

The various components of wagering game machine 800 may be connected directly to, or contained within, housing 812. Alternatively, some components of the wagering game machine may be located outside of housing 812, while being communicatively coupled with wagering game machine 800 using any suitable wired or wireless communication technology.

The operation of the basic wagering game may be displayed to the player on primary display 814. Primary display 814 may also display a bonus game associated with the basic wagering game. Primary display 814 may include a cathode ray tube (CRT), a high resolution liquid crystal display (LCD), a plasma display, light emitting diodes (LEDs), or any other type of display suitable for use in wagering game machine 800. Alternatively, primary display 814 may include a number of mechanical reels to display the outcome. Wagering game machine 800 may be an "upright" version, as shown in FIG. 8, in which primary display 814 is oriented vertically relative to the player. Alternatively, wagering game machine 800 may be a "slant-top" version in which primary display 814 is slanted at about a thirty-degree angle toward the player of wagering game machine 800. In an embodiment, wagering game machine 800 may exhibit any suitable form factor, such as a free standing model, bartop model, mobile handheld model, or workstation console model.

A player begins playing a basic wagering game by making a wager via value input device 818. The player may initiate play by using the player input device's buttons or touch screen 828. The basic game may include arranging multiple symbols along a payline 832, which indicates one or more outcomes of the basic game. Payline 832 need not be limited to horizontal lines, but may be arranged in a variety of ways including diagonal lines, vertical lines, or zigzag lines. Such outcomes may be randomly selected in response to player input. One of the outcomes, which may include any variation or combination of symbols, may trigger a bonus game.

In some embodiments, wagering game machine 800 may also include an information reader 852, which may include a card reader, ticket reader, bar code scanner, RFID transceiver, or computer readable storage medium interface. In some embodiments, information reader 852 may be used to award complimentary services, restore game assets, track player habits, etc.

Example Wagering Game Machine

Figure 9:
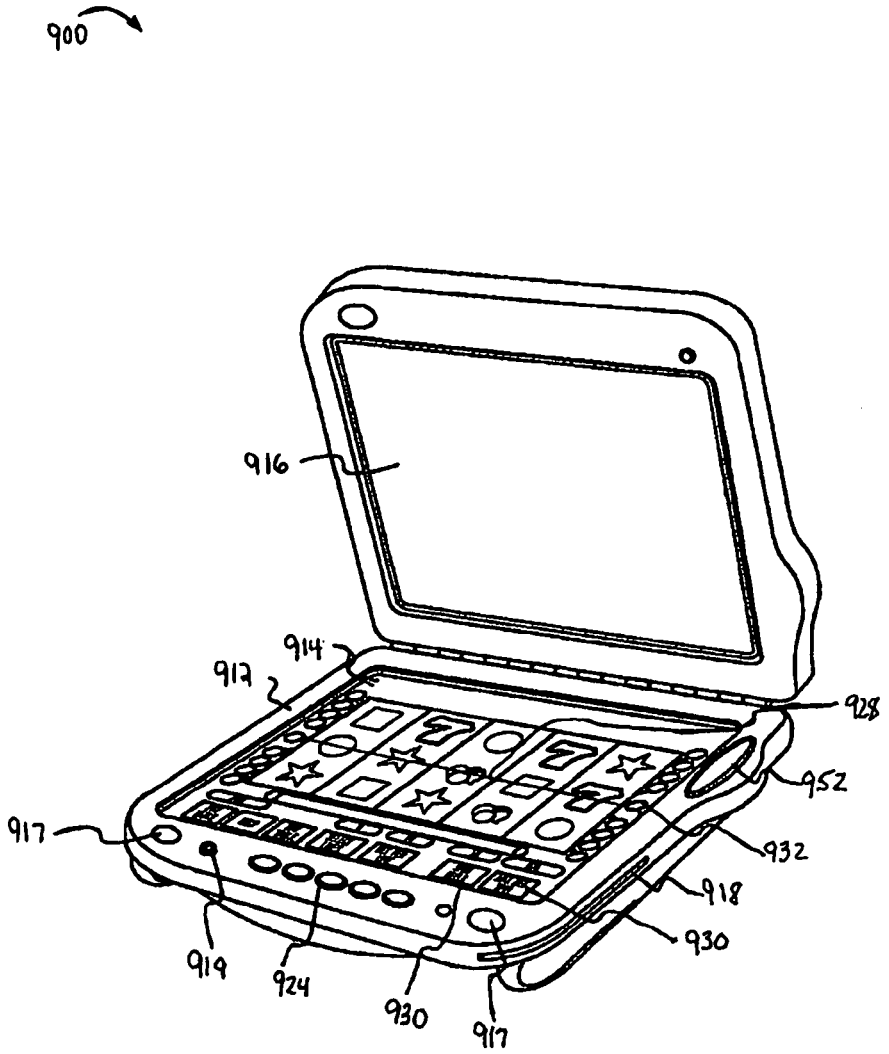
FIG. 9 illustrates an example embodiment of a wagering game machine

FIG. 9 illustrates an example embodiment of a wagering game machine 900 in which a wagering game generated in accordance with an embodiment of the present invention may be displayed and/or initiated. Like free standing wagering game machines, in a handheld or mobile form, wagering game machine 900 may include any suitable electronic device configured to play a video casino games such as blackjack, slots, keno, poker, blackjack, roulette, and video role playing games having wagering content. Wagering game machine 900 may include a housing 912 having input devices such as a value input device 918 and a player input device 924. For output, wagering game machine 900 may include a primary display 914, a secondary display 916, one or more speakers 917, one or more player-accessible ports 919 (e.g., an audio output jack for headphones, a video headset jack, etc.), and other I/O devices and ports, which may or may not be player-accessible. Wagering game machine 900 may include a secondary display 916 that is rotatable relative to primary display 914. Optional secondary display 916 may be fixed, movable, and/or detachable/attachable relative to primary display 914. Either primary display 914 and/or secondary display 916 may be configured to display any portion or feature of a non-wagering game, wagering game, secondary game, bonus game, progressive wagering game, group game, shared-experience game or event, game event, game outcome, scrolling information, text messaging, emails, alerts or announcements, broadcast information, subscription information, and wagering game machine status.

Player-accessible value input device 918 may include, for example, a slot located on the front, side, or top of housing 912 configured to receive credit from a stored-value card (e.g., casino card, smart card, debit card, credit card, etc.) inserted by a player. The player-accessible value input device 918 may also include a sensor (e.g., an RF sensor)

configured to sense a signal (e.g., an RF signal) output by a transmitter (e.g., an RF transmitter) carried by a player. The player-accessible value input device 918 may also or alternatively include a ticket reader, or barcode scanner, for reading information stored on a credit ticket, a card, or other tangible portable credit or funds storage device. The credit ticket or card may also authorize access to a central account, which may transfer money to wagering game machine 900.

Still other player-accessible value input devices 918 may make use of touch keys 930 on the touch-screen display (e.g., primary display 914 and/or secondary display 916) or player input devices 924. In an embodiment, upon entry of player identification information and secondary authorization information (e.g., a password, PIN number, stored value card number, predefined key sequences, etc.), the player may be permitted to access a player's account. As an optional security feature, wagering game machine 900 may be configured to permit a player to only access an account the player has specifically set up for wagering game machine 900. Other conventional security features may also be utilized to, for example, prevent unauthorized access to a player's account, to minimize an impact of any unauthorized access to a player's account, or to prevent unauthorized access to any personal information or funds temporarily stored on wagering game machine 900.

Player-accessible value input device 918 may itself include or utilize a biometric player information reader which permits the player to access available funds on a player's account, either alone or in combination with another of the aforementioned player-accessible value input devices 918. In an embodiment where player-accessible value input device 918 includes a biometric player information reader, transactions may all be authorized by a biometric reading from the biometric device, which may include multiple biometric readings. Such transactions may include, for example, an input of value to wagering game machine 900, a transfer of value from a player account or source to an account associated with wagering game machine 900, or the execution of another transaction.

Alternatively, to enhance security, a transaction may be optionally enabled only by a two-step process in which a secondary source confirms the identity indicated by a primary source. For example, player-accessible value input device 918 may include a biometric player information reader that may use a confirmatory entry from another biometric player information reader 952, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Any two independent sources of identity, one of which is secure or personal to the player (e.g., biometric readings, PIN number, password, etc.) may be utilized to provide enhanced security prior to the electronic transfer of any funds. Value input device 918 may be provided remotely from wagering game machine 900.

Player input device 924 may include multiple push buttons on a button panel for operating wagering game machine 900. In addition, or alternatively, player input device 924 may include a touch screen mounted to a primary display 914 and/or secondary display 916. The touch screen may be matched to a display screen having one or more selectable touch keys 930 selectable by a user's touching of the associated area of the screen using a finger or a tool, such as a stylus pointer. A player enables a desired function either by touching the touch screen at an appropriate touch key 930 or by pressing an appropriate push button on the button panel. Touch keys 930 may be used to implement the same functions as push buttons. Alternatively, push buttons 932 may provide inputs for operating one part of the game, while touch keys 930 may allow for input needed for another part of the game. The various components of wagering game machine 900 may be connected directly to, or contained within, housing 912 or may be located outside housing 912 and connected to housing 912 via a variety of wired (tethered) or wireless connection methods. Thus, wagering game machine 900 may be configured as a single unit or as multiple interconnected (e.g., wireless connections) parts, which may be arranged to suit a player's preferences.

The operation of the basic wagering game on wagering game machine 900 may be displayed to the player on primary display 914. Primary display 914 may also display one or more bonus games associated with the basic wagering game. Primary display 914 may take the form of a high resolution LCD, a plasma display, an LED, or any other type of display suitable for use in wagering game machine 900. The size of primary display 914 may vary from, for example, about a 2-3" display to a 15" or 17" display. In some embodiments, primary display 914 is a 7"-10" display. However, primary display 914 is not limited to the above sizes. In an embodiment, the size of the primary display may be increased. Optionally, coatings or removable films or sheets may be applied to the display to provide desired characteristics (e.g., anti-scratch, anti-glare, bacterially-resistant and anti-microbial films, etc.). In various embodiments, primary display 914 and/or secondary display 916 may have a 16:9 aspect ratio or other aspect ratio (e.g., 4:3). Primary display 914 and/or secondary display 916 may also each have different resolutions, different color schemes, and different aspect ratios.

As with free standing embodiments, a player begins play of the basic wagering game on wagering game machine 900 by making a wager (e.g., via value input device 918 or an assignment of credits stored on the handheld gaming machine via touch screen keys 930, player input device 924, or buttons 932) on wagering game machine 900. In various embodiments, a wagering game may include multiple symbols arranged in an array and may include at least one payline 928 that indicates one or more outcomes of the wagering game. Payline 928 may be horizontal lines or may be arranged in a variety of ways, including diagonal lines, vertical lines, or zigzag lines. Such outcomes may be randomly selected in response to the wagering input by the player. One or more randomly selected outcomes may be a start-bonus outcome, which may include any variations of symbols or symbol combinations triggering a bonus game.

In various embodiments, player-accessible value input device 918 of wagering game machine 900 may double as a player information reader 952 that allows for identification of a player by reading a card with information indicating the player's identity (e.g., reading a player's credit card, player ID card, smart card, etc.). Player information reader 952 may alternatively or also include a bar code scanner, RFID transceiver or computer readable storage medium interface. In an embodiment, player information reader 952 may include a biometric sensing device.

In the above detailed description, reference may be made to specific examples by way of drawings and illustrations. It is to be understood that the above description is intended to be illustrative, and not restrictive, and that the phraseology or terminology employed herein is for the purpose of description and not of limitation. These examples are described in sufficient detail to enable those skilled in the art to practice embodiments of the inventive subject matter, and serve to illustrate how the inventive subject matter may be applied to various purposes or embodiments. Other embodiments may be included within the inventive subject matter, as logical, mechanical, electrical, and other changes may be made to the example embodiments described herein. The various embodiments are not necessarily mutually exclusive, as some embodiments may be combined with one or more other embodiments to form new embodiments. Features or limitations of various embodiments described herein do not limit the inventive subject matter as a whole, and any reference to the invention, its elements, operation, and application are not limiting as a whole, but serve only to define these example embodiments. The above detailed description does not, therefore, limit embodiments of the invention.

What is claimed is:

1. A method of automatically generating a wagering game in response to a game selection via a wagering game machine primarily dedicated to use in conducting a casino wagering game, the wagering game machine including an electronic display device, a value input device, and one or more electronic input devices, the method comprising:

detecting, via the value input device, a physical item associated with a monetary value that establishes a credit balance;

receiving, via at least one of the one or more electronic input devices, a wagering game selection including at least a selection of a first wagering game;

initiating the selected first wagering game in response to an input indicative of a wager covered by the credit balance; and receiving, via at least one of the one or more electronic input devices, a cashout input that initiates a payout from the credit balance, wherein, in response to receiving the wagering game selection via the wagering game machine, the method further includes the acts of:

selecting, via one or more controllers operatively associated with the wagering game machine, a rule set associated with the wagering game selection, the selected rule set including criteria for building a second wagering game;

building, via the one or more controllers according to the criteria included in the selected rule set, the second wagering game comprising a plurality of possible second wagering game outcomes that are displayed as symbols on the electronic display device, the second wagering game outcomes being randomly determined by the one or more controllers, wherein at least one first outcome of the plurality enables a player to play the first wagering game on the wagering game machine;

initiating the second wagering game in response to an input from a player indicative of a wager; and generating, via the one or more controllers and in accordance with the selected rule set, a probability of at least one second outcome of the plurality occurring during play of the second wagering game on the wagering game machine, wherein the generated probability is such that the second wagering game is compatible with the wagering game selection.

2. The method of claim 1, wherein the wagering game selection further includes a selection of a third wagering game and the selected rule set includes a first rule set associated with the first wagering game and a third rule set associated with the third wagering game.

3. The method of claim 1, wherein the wagering game selection further includes a selection of at least one of a wagering game volatility, a wagering game theme, or a wagering game setting.

4. The method of claim 1, wherein the first wagering game is a bonus game selected from a plurality of bonus games, and the second wagering game is a base wagering game that can initiate the first wagering game.

5. The method of claim 4, wherein the probability is such that an expected value of the first wagering game, as well as a combined expected value of the first and second wagering game, remain constant.

6. The method of claim 1, wherein the first outcome and the second outcome are the same outcome.

7. The method of claim 1, wherein the at least one second wagering game outcome is displayed on a plurality of moveable reels via the electronic display device.

8. The method of claim 1, wherein generating the probability comprises generating the symbols on at least one reel strip of at least one moveable reel displayed via the electronic display device of the wagering game machine.

9. The method of claim 1, wherein the act of generating the probability via the one or more controllers comprises generating probabilities of two or more second wagering game outcomes of the plurality occurring during play of the second wagering game on the wagering game machine, wherein the generated probabilities are such that the second wagering game is compatible with the wagering game selection.

10. The method of claim 1, wherein the act of generating the probability via the one or more controllers comprises generating symbols on a first reel strip on a first moveable reel, the first reel strip including a first symbol that occurs at a frequency within a first frequency range, and generating symbols on a second reel strip on a second moveable reel, the second reel strip including a second symbol that occurs at a frequency within a second frequency range.

11. A casino wagering game system comprising:

a wagering game machine primarily dedicated to playing at least one casino wagering game, the gaming machine including an electronic display device, a value input device, and one or more electronic input devices; and one or more controllers configured to:

detect, via the value input device, a physical item associated with a monetary value that establishes a credit balance;

receive, from the wagering game machine, a wagering game selection including at least a selection of a first wagering game;

initiate the selected wagering game in response to an input indicative of a wager covered by the credit balance; and receive, via at least one of the one or more electronic input devices, a cashout input that initiates a payout from the credit balance, wherein, in response to receiving the wagering game selection from the wagering game machine, the one or more controllers are further configured to:

select a rule set associated with the wagering game selection, the selected rule set including criteria for building a second wagering game;

build, according to the criteria included in the selected rule set, the second wagering game comprising a plurality of possible second wagering game outcomes randomly determined by the one or more controllers that are displayed as symbols, wherein at least one first outcome of the plurality enables a player to play the first wagering game on the wagering game machine;

initiate the second wagering game in response to an input indicative of a wager from a player; and generate using the one or more controllers, in accordance with the selected rule set, a probability of at least one second outcome of the plurality occurring during play of the second wagering game on the wagering game machine, wherein the generated probability is such that the second wagering game is compatible with the wagering game selection.

12. The casino wagering game system of claim 11, wherein the first wagering game is a bonus game selected from a plurality of bonus wagering games, and the second wagering game is a base wagering game that can initiate the first wagering game.

13. The casino wagering game system of claim 11, wherein the probability is such that an expected value of the first wagering game, as well as a combined expected value of the first and second wagering games, remain constant.

14. The casino wagering game system of claim 11, wherein the first outcome and the second outcome are the same outcome.

15. The casino wagering game system of claim 11, further comprising a wagering game server on a communications network, wherein machine-executable instructions executed by the one or more controllers reside on a wagering game server non-transitory machine-readable medium.

16. The casino wagering game system of claim 11, wherein the act of generating the probability using the one or more controllers comprises generating probabilities of two or more second wagering game outcomes of the plurality occurring during play of the second wagering game, wherein the generated probabilities are such that the second wagering game is compatible with the wagering game selection.

17. A casino wagering game system comprising:

a wagering game machine primarily dedicated to playing at least one casino wagering game, the wagering game machine including an electronic display device, a value input device, and one or more electronic input devices;

one or more controllers; and at least one physical, non-transient machine-readable memory device bearing instructions which, when executed by the one or more controllers, cause the one or more controllers to operate with the electronic display device, the value input device, and the one or more input devices to detect, via the value input device, a physical item associated with a monetary value that establishes a credit balance, receive a wagering game selection including at least a selection of a first wagering game and, in response to receiving the wagering game selection, to cause the one or more controllers to:

initiate the wagering game in response to an input indicative of a wager covered by the credit balance;

select a rule set associated with the wagering game selection, the selected rule set including criteria for building a second wagering game;

build, according to the criteria included in the selected rule set, the second wagering game comprising a plurality of possible second wagering game outcomes that are displayed as symbols, the second wagering game outcomes being randomly determined by the one or more controllers, wherein at least one first outcome of the plurality enables play of the first wagering game on the wagering game machine;

initiate the second wagering game in response to an input indicative of a wager covered by the credit balance; and generate, in accordance with the selected rule set, a probability of at least one second outcome of the plurality occurring during play of the second wagering game on the wagering game machine, wherein the generated probability is such that the second wagering game is compatible with the wagering game selection.

18. The casino wagering game system of claim 17, wherein the player makes the game selection using one of the one or more electronic input devices of the wagering game machine.

19. The casino wagering game system of claim 17, wherein the game selection further includes a selection of a third wagering game and the selected rule set includes a first rule set associated with the first wagering game and a third rule set associated with the third wagering game.

20. The casino wagering game system of claim 17, wherein the rule set for the second wagering game is selected from a plurality of rule sets stored on a wagering game server non-transitory machine-readable medium.

21. The casino wagering game system of claim 17, wherein the first wagering game is a bonus wagering game selected from a plurality of bonus wagering games, and the second wagering game is a base wagering game that can initiate the first wagering game.

22. The casino wagering game system of claim 17, wherein the first outcome and the second outcome are the same outcome.

23. The casino wagering game system of claim 17, wherein the act of generating the probability using the one or more controllers includes generating symbols on at least one reel strip on at least one moveable reel.

24. The casino wagering game system of claim 17, wherein the act of generating the probability using the one or more controllers comprises generating probabilities of two or more second wagering game outcomes of the plurality occurring during play of the second wagering game on the wagering game machine, wherein the generated probabilities are such that the second wagering game is compatible with the wagering game selection.

25. A wagering game system comprising:

a communications network across which the wagering game system operates to extemporaneously generate a wagering game in response to a wagering game selection;

a wagering game server having one or more non-transitory machine-readable server memory devices;

at least one wagering game machine primarily dedicated to playing at least one casino wagering game communicatively connected to the communications network via a communication device, the wagering game machine including an electronic display device, a value input device, and one or more electronic input devices;

one or more controllers operating with the wagering game server and the at least one wagering game machine to:

detect, via the value input device, a physical item associated with a monetary value that establishes a credit balance;

receive, from the wagering game machine, a wagering game selection including at least a selection of a first wagering game;

initiate a selected wagering game in response to an input indicative of a wager covered by the credit balance; and receive, via at least one of the one or more electronic input devices, a cashout input that initiates a payout from the credit balance, wherein, in response to receiving the wagering game selection, the one or more controllers operating with the wagering game server and the at least one wagering game machine are further configured to:

select a rule set associated with the wagering game selection, the selected rule set including criteria for building a second wagering game;

build, according to the criteria included in the selected rule set, the second wagering game comprising a plurality of possible second wagering game outcomes that are displayed as symbols, the second wagering game outcomes being randomly determined by the one or more controllers, wherein at least one first outcome of the plurality enables a player to play the first wagering game;

initiate the selected wagering game in response to an input indicative of a wager from a player; and generate, in accordance with the selected rule set, a probability of at least one second outcome of the plurality occurring during play of the second wagering game, wherein the generated probability is such that the second wagering game is compatible with the wagering game selection.

26. The wagering game system of claim 25, wherein the wagering game server, the wagering game machine, and the one or more controllers are connected for communication via the communications network and wherein the wagering game server is spaced apart from the one or more controllers and the wagering game machine.

27. The wagering game system of claim 25, wherein the wagering game selection is made by the player via at least one of the one or more electronic input devices.

28. The wagering game system of claim 25, wherein the rule set for the second wagering game is selected from a plurality of rule sets stored on the one or more server memory devices.

29. The wagering game system of claim 25, wherein the first wagering game is a bonus wagering game selected from a plurality of bonus wagering games, and the second wagering game is a base wagering game that can initiate the first wagering game.

30. The wagering game system of claim 25, wherein the first outcome and the second outcome are the same outcome.

31. The casino wagering game system of claim 25, wherein the act of generating the probability using the one or more controllers comprises generating symbols on a first reel strip on a first moveable reel, the first reel strip including a first symbol that occurs at a frequency within first frequency range, and generating symbols on a second reel strip on a second moveable reel, the second reel strip including a second symbol that occurs at a frequency within a second frequency range.

* * * * *